United States Patent [19]

Nishina et al.

[11] 4,121,935

[45] Oct. 24, 1978

[54] LITH-TYPE SILVER HALIDE PHOTOGRAPHIC LIGHT-SENSITIVE MATERIAL

[75] Inventors: Yoshio Nishina; Teiji Habu; Tomio Nakajima; Akio Oshima; Eiichi Sakamoto; Noboru Fujimori; Kiyomitsu Mine; Hiroo Toya, all of Hino, Japan

[73] Assignee: Konishiroku Photo Industry Co., Ltd., Tokyo, Japan

[21] Appl. No.: 822,601

[22] Filed: Aug. 8, 1977

Related U.S. Application Data

[63] Continuation of Ser. No. 613,628, Sep. 15, 1975, abandoned.

[30] Foreign Application Priority Data

Sep. 24, 1974 [JP] Japan ..... 49/07314

[51] Int. Cl.[2] ..... G03C 5/04; G03C 1/18; G03C 1/06

[52] U.S. Cl. ..... 96/27 E; 96/33; 96/95; 96/137

[58] Field of Search ..... 96/27 H, 27 E, 137, 96/95, 33

[56] References Cited

U.S. PATENT DOCUMENTS

| | | | |
|---|---|---|---|
| 3,232,761 | 2/1966 | Allen | 96/66 R |
| 3,775,111 | 11/1973 | Norman | 96/27 H |
| 3,775,114 | 11/1973 | Gracia et al. | 96/33 |
| 3,867,146 | 2/1975 | Nakazawa et al. | 96/27 H |
| 3,895,948 | 7/1975 | Shiba et al. | 96/95 |
| 3,915,713 | 10/1975 | Shiba et al. | 96/95 |

OTHER PUBLICATIONS

J. Opt. Soc. Am., vol. 53, No. 12, Dec. 1963, pp. 1377–1381.

Applied Optics, Nov. 1969, vol. 8, No. 11, pp. 2353–2354.

Data Release, Eastman Kodak, 1969, pp. 1–10.

*Primary Examiner*—Mary F. Kelley

*Attorney, Agent, or Firm*—Bierman & Bierman

[57] ABSTRACT

A lith-type silver halide photographic light-sensitive material for forming halftone dot images is disclosed which contains a sensitizing dye represented by the following general formula:

wherein $Z_1$ is an atomic group necessary for forming a naphthothiazole ring, $Z_2$ is an atomic group necessary for forming a member selected from a group consisting of substituted or unsubstituted, benzothiazole, benzoselenazole, naphthothiazole and naphthoselenazole nucleus, $R_1$ and $R_2$ are respectively a substituted or unsubstituted alkyl group, $X^{\theta}$ is an anion, and $n$ is a positive integer of 1 or 2 with the proviso that when the dye is an inner salt, $n$ is 1.

1 Claim, No Drawings

LITH-TYPE SILVER HALIDE PHOTOGRAPHIC LIGHT-SENSITIVE MATERIAL

This is a continuation application of Ser. No. 613,628 filed Sept. 15, 1975 now abandoned and which claims the priority of Japanese Patent Application No. 107314/1974 filed on Sept. 17, 1974.

DETAILED DESCRIPTION OF THE INVENTION

This invention relates to a lith-type silver halide photographic light-sensitive material for forming halftone dot images by the scanner process using neon-helium laser beams as light source. More particularly, the invention relates to such lith-type silver halide photographic light-sensitive material which comprises a silver halide emulsion containing 60 to 90 chloride, 10 to 40 bromide and less than 5 mole percent iodide, has a high sensitivity to a wave length inherent of neon-helium laser beams, namely a wave length of 6328 nm, and exhibits excellent in reciprocity law failure and dot image-forming property at high-illuminance and short-time exposure less than $10^{-4}$ second.

A so-called scanner process for forming images by scanning an original, light-exposing a silver halide photographic photosensitive material based on the resulting image signal and thus forming a negative or positive image corresponding to the original image is known in the art. This scanner process is divided into two types. According to one type, an ordinary silver halide photographic light-sensitive material is used to form an image having a continuous gradation and according to the other type a lith-type silver halide photographic light-sensitive material is used to obtain a halftone dot image. In industries of printing and photo-engraving, the latter process is now used more frequently than the former process because the latter process provides sharp images excellent in the resolving power and the engraving process can be shortened to enable labor-saving. The scanner process forming halftone dot images is divided in a so-called dot generating system for forming halftone dots by using a dot generator and a system for forming halftone dots by using a contact screen. As the light source for a dot-generating machine used in these systems (for example, electronic direct color-scanner), there have heretofore been mainly used a glow-discharge lamp, a xenon lamp, a mercury lamp and the like. However, each of these light sources involves practical difficulties, because of a relatively low power and a relatively short life. Recently, use of coherent laser beams as light source has been tried and halftone dot-generating machines including this light source have been developed.

As the medium for generator of laser beam, there are employed ruby, neon-helium gas, argon gas, krypton gas, cadmium gas, carbon dioxide gas and the like. A laser beam generator using neon-helium gas are employed most broadly, because they are cheaper than other generator and stable outputs can be obtained.

A wave length of laser beams generated by a neon-helium laser is 6328 nm. Accordingly, lith-type silver halide photographic light-sensitive materials to be used for forming halftone dot images by employing an electronic direct color-scanner are required to have a high sensitivity to a wave length of 6328 nm and an excellent adaptability to high-illuminance short-time exposure (especially one conducted for less than $10^{-4}$ second) which is an indispensable requirement for formation of halftone dots according to the scanner process. However, conventional lith-type silver halide photographic light-sensitive materials do not always possess a sufficient sensitivity to neon-helium laser beams, exhibit remarkable reciprocity failure at the high-illuminance short-time exposure and are insufficient in the dot quality. Accordingly, none of now available lith-type silver halide photographic light-sensitive materials can be practically used for formation of halftone dot images according to the scanner process.

It is therefore a primary object of this invention to provide a lith-type silver halide photographic light-sensitive material for forming halftone dot images according to the scanner process using neon-helium laser beams as light source, which has a high sensitivity to a wave length of 6328 nm inherent of neon-helium laser beams and is excellent in reciprocity law failure at the high-illuminance short-time exposure (especially one conducted for less than $10^{-4}$ second) and in dot quality.

It has been found that the foregoing object can be attained by sensitizing a silver halide by incorporating a carbocyanine sensitizing dye represented by the following general formula into a lith-type silver halide photographic light-sensitive material:

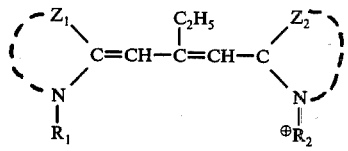

$(X^{\ominus})_{n-1}$

In the above general formula, $Z_1$ stands for a group of atoms necessary for formation of a naphthothiazole ring, and $Z_2$ stands for a group of non-metallic atoms necessary for formation of an substituted or unsubstituted benzthiazole, benzselenazole, naphthothiazole or naphthoselenazole nucleus. As the benzthiazole nucleus, there can be mentioned, for example, nuclei of benzthiazole, 5-chlorobenzthiazole, 5-methylbenzthiazole, 5-methoxybenzthiazole, 5-hydroxybenzthiazole, 5-hydroxy-6-methylbenzthiazole, 5,6-dimethylbenzthiazole, 5-phenylbenzthiazole, 5-carboxybenzthiazole, 5-ethoxycarbonylbenzthiazole, 5-dimethylaminobenzthiazole and 5-acetylaminobenzthiazole. As the benzselenazole nucleus, there can be mentioned, for example, nuclei of benzselenasole, 5-chlorobenzselenazole, 5-methylbenzselenazole, 5-methoxybenzselenazole, 5-hydroxybenzselenazole, 5,6-dimethylbenzselenazole, 5,6-dimethoxybenzselenazole, 5-ethoxy-6-methylbenzselenazole, 5-hydroxy-6-methylbenzselenazole and 5-phenylbenzselenazole. As the naphthothiazole nucleus, there can be mentioned, for example, nuclei of $\beta$-naphthothiazole and $\beta,\beta$-naphthothiazole. As the naphthoselenazole nucleus, there can be mentioned, for example, a nucleus of $\beta$-naphthoselenazole. $R_1$ and $R_2$ stand for a lower alkyl group or a substituted lower alkyl group. As specific examples of $R_1$ and $R_2$, there can be mentioned methyl, ethyl, n-propyl, $\beta$-carboxyethyl, $\gamma$-sulfopropyl, $\gamma$-sulfobutyl, $\delta$-sulfobutyl and sulfoethoxyethyl groups. $X\ominus$ designates an anion such as a halogen ion, a perchloric ion, thiocyanic ion, a benzene-sulfonic ion, a p-toluene-sulfonic ion and a methylsulfuric ion, and $n$ is a positive integer of 1 or 2 with the proviso that when the dye is an inner salt, $n$ is 1.

The sensitizing dye of this invention is a thiacarbocyanine or selenacarbocyanine having an ethyl group substituted at the meso-position of the trimethine chain, and the sensitizing dye has a J-band sensitizing property which is advantageous for spectral sensitization in a specific wave length region.

Typical instances of the sensitizing dye of this invention will now be illustrated.

[Illustrative Sensitizing Dyes]

(1)

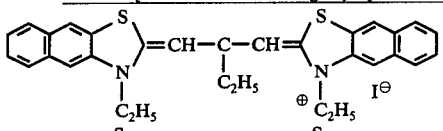

(2)

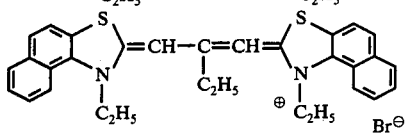

(3)

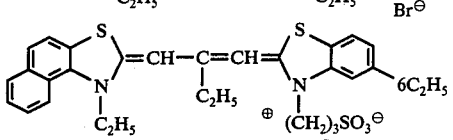

(4)

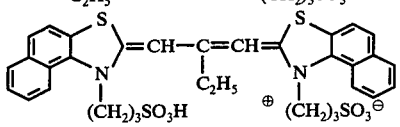

(5)

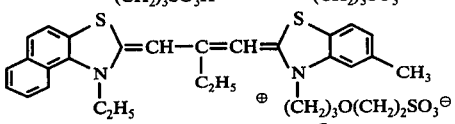

(6)

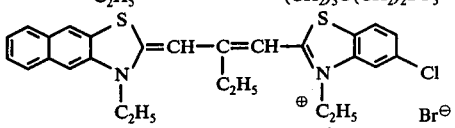

(7)

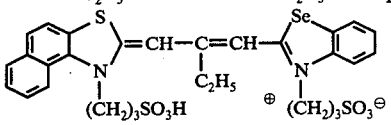

(8)

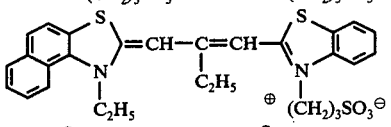

(9)

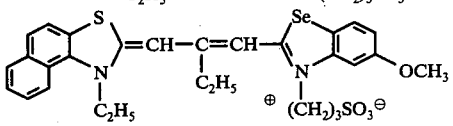

(10)

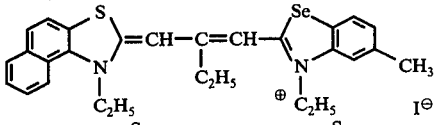

(11)

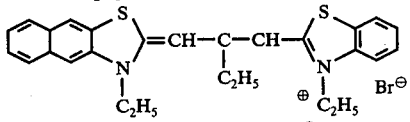

(12)

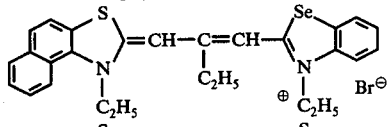

(13)

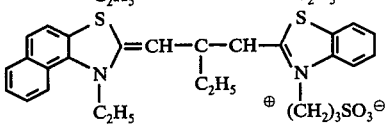

-continued

[Illustrative Sensitizing Dyes]

(14)

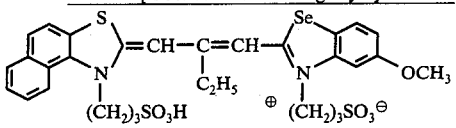

(15)

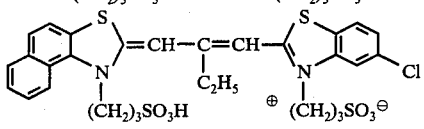

These sensitizing dyes of this invention can easily be synthesized according to methods disclosed in the specifications of British Pat. No. 660,408 and U.S. Pat. No. 3,149,105.

Incorporation of the sensitizing dye of this invention into a silver halide emulsion can be accomplished by mixing and dissolving the dye into a coating solution, or by addding to a coating solution the dye in the state dissolved in one or more of water and such organic solvents as methanol, ethanol, acetone and fluorinated alcohols.

The amount incorporated of the sensitizing dye of this invention is varied depending on the kind of the silver halide emulsion and the kind of the compound, but in general, the sensitizing dye is used in an amount of 5 to 500 mg per mole of the silver halide but this range is not particularly critical. In short, the sensitizing dye is incorporated in the silver halide emulsion in an optimum amount so that best results are obtained.

The sensitizing dye of this invention may be incorporated at any stage, but in general, it is preferred that the sensitizing dye be incorporated after completion of aging but just before coating.

The lith-type solver halide photographic light-sensitive material of this invention is a photosensitive material for printing, especially a photosensitive material for negative or positive printing which undergoes infectious development. Various materials conventionally used for lith-type silver halide photographic light-sensitive materials, for example, supports, additives and binders to be used for silver halide emulsion layers and other structural layers, and the like, can be used in this invention. As the support, there can be employed, for example, films of polyethylene terephthalate, polycarbonate, polystyrene, polypropylene and cellulose acetate. As the binder to be used for formation of silver halide emulsion layers and other structural layers, there can be mentioned, for example, gelatin, acetylated gelatin, phthalated gelatin, colloidal albumin, agar, gum arabic, alginic acid, cellulose derivatives such as cellulose acetate hydrolyzed so that the acetyl content is reduced to 19 to 26%, acrylamide, imidated polyacrylamide, casein, vinyl alcohol polymers containing a urethanecarboxylic acid group or cyanoacetyl group, such as a vinyl alcohol-vinyl cyanoacetate copolymer, polyvinyl alcohol, polyvinyl pyrrolidone, hydrolyzed polyvinyl acetate and polymers obtained by polymerizing a protein or protein modified with a saturated acyl group with a vinyl group-containing monomer. Various silver halides such as silver bromide, silver chloride, silver chlorobromide, silver iodobromide and silver iodochlorobromide are used for preparation of silver halide emulsions. These silver halide emulsions may be sensitized by chemical sensitizing agents such as sulfur sensitizing agents, e.g., allyl thiocarbamide, thiourea, allyl isocyanate and cysteine, active or inactive selenium sensitizers, gold compounds, e.g., potassium chloroaurate, auric trichloride, potassium auric thiocyanate and 2-aurothiabenzthiazole methylchloride, palladium compounds, e.g., ammonium chloropalladate and sodium chloroppalladite, platinum compounds, e.g., potassium chloroplatinate, ruthenium compounds, rhodium compounds, and other novel metal sensitizing agents, e.g., iridium compound. These sensitizing agents can be used singly or in the form of a mixture of two or more of them. Further, the emulsions may be sensitized by reducing agents as well as the foregoing chemical sensitizing agents. Moreover, the emulsions may be stabilized by a triazole, an imidazole, an azaindene compound, a benzthiazolium compound, a zinc compound, a cadmium compound, a mercaptan or a mixture thereof. Still further, the emulsions may be sensitized by a thioether type quaternary ammonium salt or the like. Still in addition, if desired, the high-illuminance characteristic of the emulsions can be improved by using a pyrazolone compound disclosed U.S. Pat. No. 3,594,173, or the dot-forming characteristic of the emulsions may be improved by addition of a polyalkylene oxide compound.

Moreover, swelling agents, plasticizers and film property-improving agents such as glycerin, dihydroxyalkanes, e.g., 1,5-pentane diol, esters of ethylene-bis-glycolic acid, bis-ethoxydiethylene glycol succinate and water-dispersible particulate polymeric compounds formed by emulsion polymerization may be incorporated in the emulsions. Furthermore, film-hardening agents such as ethylene-imine type compounds, dioxane derivatives, hydroxypolysaccharides, dicarboxylic chlorides and diesters of methanesulfonic acid, coating assistants such as saponin and sulfosuccinic acid salts, fluorescent whitening agents, surfactants, anti-staining agents and other photographic additives. Still in addition, the emulsions may be sensitized by a sensitizing dye other than the dye represented by the above general formula, such as a cyanine dye, merocyanine dye and a composite cyanine dye.

Still further, in order to improve the stability to dark room rays, for example, a compound disclosed in Japanese Patent Application Laid-Open Specification No. 60918/73, may be incorporated as a photographic dye into the emulsions.

This invention will now be illustrated in detail by reference to the following Examples that by no means limit the scope and embodiments of this invention.

EXAMPLE 1

A methanol solution of a sensitizing dye of this invention was incorporated into a silver chlorobromide (comprising 80 mole % of silver chloride and 20 mole % of silver bromide) emulsion prepared by a known method, prior to coating in such an amount that the content of the sensitizing dye was 150 mg per mole of the silver halide, and known additives necessary for photographic materials were further added to the emulsion, to thereby from a lith-type silver halide photographic emulsion. For comparison, emulsions were similarly prepared by using the following comparative sensitizing dyes.

Each of the so prepared emulsions was coated and dried on a polyethylene terephthalate film to obtain a sample.

[Comparative Sensitizing Dyes]

[A]

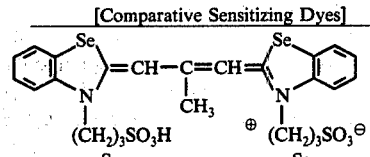

[B]

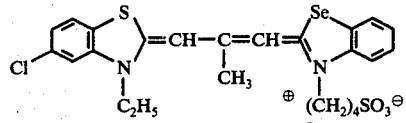

[C]

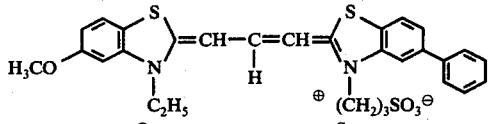

[D]

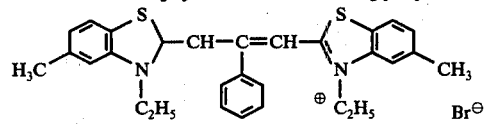

The so prepared samples were exposed to light according to the following two methods:

Method (1

A gray contact screen (50 lines/inch; manufactured by Dainippon Screen) was placed in the state contacting closely to the sample, and light exposure was carried out for 2 seconds through an ordinary light wedge by using a sensitometer (tungsten rays of 2854° D) and an interference filter allowing passage of red light of a wave length of 631.5nm.

Method (2)

A gray contact screen (150 lines/inch; manufactured by Dainippon Screen) was placed in the state contacting closely to the sample, and light exposure was conducted for 1/10000 second by using a neon-helium laser generator (Gas Laser GLS 2004 manufactured by Nippon Denki Kabushiki Kaisha) and a neutral gray wedge.

Exposure amount was adjusted by the neutral gray filter so that it was maintained at the same level in both the methods (1) and (2).

After the above exposure, development was carried out by using a lith-type developer having the following composition and the sensitivity and dot quality at the optimum time point (the time of development required for obtaining sharpest dots) were determined.

In the case of the light exposure method (2) the optimum development time appeared very slightly later than in the case of the method (1), but since this time lag was within several seconds, no disadvantage was brought about even when evaluation was made based on the same development time. Composition of Developer (development was conducted at 27° C.):

| | |
|---|---|
| hydroquinone | 16 g |
| formaldehyde sodium hydrogensulfite | 50 g |
| sodium sulfite | 2 g |
| potassium bromide | 1 g |
| sodium carbonate (monohydrate) | 60 g |
| triethylene glycol | 40 g |
| water | balance |
| total | 1000 ml |

Results of measurement of the photosensitivity and dot quality of the developed samples are as shown in Table 1.

In the Table, values of the relative sensitivity are relative values based on the sensitivity (100) of the comparative sensitizing dye [A] observed in the interference filter light-exposure method [method (1)]. The dot quality was evaluated based on the sharpness of the dot silver image observed under a microscope according to the 5-graduated scale in which point "1" was given to the worst image and point "5" was given to the best image.

Table 1

| Used Compound | Exposed by Method (1) Relative Speed | Exposed by Method (1) Dot Quality | Exposed by Method (2) Relative Speed | Exposed by Method (2) Dot Quality | Optimum Point (Development Time) |
|---|---|---|---|---|---|
| 1 | 110 | 3 | 115 | 4 | 97 |
| 2 | 125 | 4 | 125 | 5 | 95 |
| 5 | 120 | 4 | 120 | 5 | 98 |
| 7 | 105 | 4 | 110 | 5 | 100 |
| 8 | 115 | 3 | 115 | 4 | 95 |
| 13 | 125 | 4 | 125 | 5 | 95 |
| A | 100 | 3 | 92 | 2 | 130 |
| B | 90 | 4 | 90 | 2 | 100 |
| C | 100 | 3 | 80 | 2 | 150 |
| D | 85 | 3 | 80 | 1 | 130 |

As is seen from the results shown in Table 1, lith-type films containing a sensitizing dye of this invention exhibit higher sensitivity and better dot quality when exposed according to the neon-helium laser beam exposure method [method (2)] than when exposed according to the interference filter exposure [method (1)].

It is also seen that sensitizing dyes of this invention are much excellent over the comparative sensitizing dyes in photographic characteristics. What must be noted is that even if no substantial difference of the sensitivity is brought about by the difference of the light exposure method, a distinct difference of the dot quality is observed between the sensitizing dyes of this invention and the comparative sensitizing dyes when the high-illuminance short-time exposure is carried out by using coherent laser beams.

EXAMPLE 2

Samples prepared in the same manner as described in Example 1 were exposed to neon-helium laser beams having an output of 2 nW and developed by using the same liquid developer as used in Example 1 while changing the developing time.

Dot silver images were examined under a microscope, and the optimum development time (optimum point) required for obtaining sharpest images was determined with respect to each sample to obtain results shown in Table 2.

Table 2

| Used Compound | Optimum Point (Development Time) | Dot Quality |
|---|---|---|
| 1 | 95 | 4 |
| 2 | 95 | 5 |
| 3 | 97 | 4 |
| 4 | 94 | 4 |
| 5 | 100 | 5 |
| 10 | 95 | 5 |
| 15 | 97 | 4 |
| A | 130 | 3 |
| B | 100 | 3 |
| C | 150 | 2 |
| D | 130 | 3 |

As is apparent from the results shown in Table 2, lith-type films containing a sensitizing dye of this invention exhibit better dot quality than that obtained from lith-films containing the comparative sensitizing dye [A], [B], [C] or [D].

What is claimed is:

1. A method of forming halftone dot images comprising imagewise exposing a photographic light sensitive material with neon helium laser beams, and developing said exposed photographic light sensitive material with an infectious developer, said photographic light sensitive material comprising a silver halide emulsion wherein said silver halide contains 60 to 90 mole percent of silver chloride, 10 to 40 mole percent of silver bromide and less than 5 mole percent of silver iodide, and a sensitizing dye selected from the group consisting of:

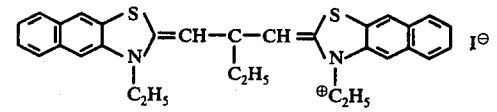
(1)

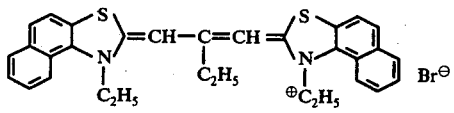
(2)

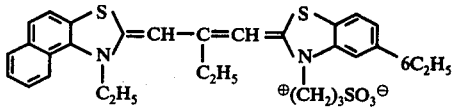
(3)

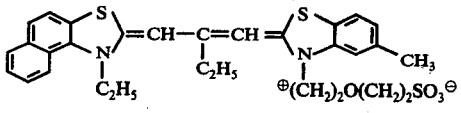
(4)

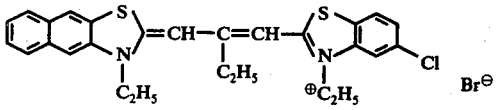
(5)

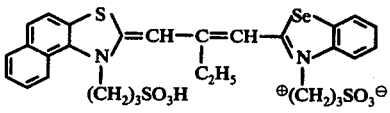
(6)

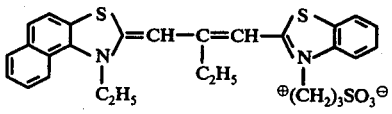
(7)

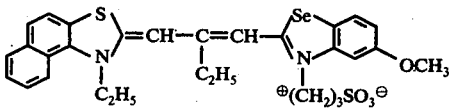
(8)

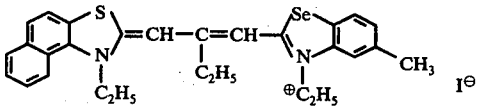
(9)

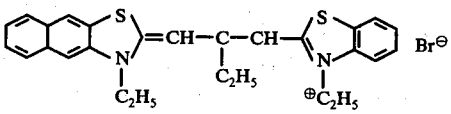
(10)

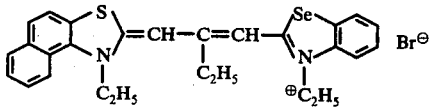
(11)

-continued
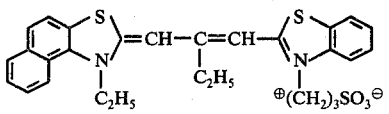
(12)
-continued
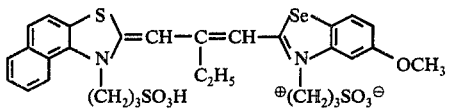
(13)
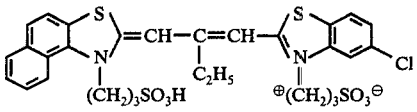
(14)
* * * * *

UNITED STATES PATENT OFFICE

CERTIFICATE OF CORRECTION

PATENT NO. : 4,121,935

DATED : October 24, 1978

INVENTOR(S) : Yoshio Nishina, et al

It is certified that error appears in the above-identified patent and that said Letters Patent are hereby corrected as shown below:

On Page 1, an error was made at line [30] and should read as follows:

[30] Foreign Application Priority Data
Sep. 17, 1974 [JP] Japan..... 49-107314

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*